US009528766B2

(12) United States Patent
Matusewicz et al.

(10) Patent No.: US 9,528,766 B2
(45) **Date of Patent: *Dec. 27, 2016**

(54) TOP SUBMERGED INJECTING LANCES

(75) Inventors: Robert Matusewicz, Oakleigh (AU); Markus Reuter, Helsinki (FI)

(73) Assignee: Outotec Oyj, Espoo (FI)

( * ) Notice: Subject to any disclaimer, the term of this patent is extended or adjusted under 35 U.S.C. 154(b) by 276 days.

This patent is subject to a terminal disclaimer.

(21) Appl. No.: 14/130,115

(22) PCT Filed: Jun. 27, 2012

(86) PCT No.: PCT/AU2012/000751

§ 371 (c)(1),
(2), (4) Date: Feb. 17, 2014

(87) PCT Pub. No.: WO2013/000017

PCT Pub. Date: Jan. 3, 2013

(65) Prior Publication Data

US 2014/0151942 A1 Jun. 5, 2014

(30) Foreign Application Priority Data

Jun. 30, 2011 (AU) ..... 2011902598

(51) Int. Cl.

| | |
|---|---|
| ***C21C 5/46*** | (2006.01) |
| ***F27D 3/16*** | (2006.01) |
| *C21C 5/34* | (2006.01) |

(52) U.S. Cl.

CPC ..... *F27D 3/16* (2013.01); *C21C 5/4606* (2013.01); *C21C 5/4613* (2013.01);
(Continued)

(58) Field of Classification Search

CPC ..... C21C 5/4606; C21C 5/4613
(Continued)

(56) References Cited

U.S. PATENT DOCUMENTS

| | | | |
|---|---|---|---|
| 3,223,398 | A | 12/1965 | Bertram et al. |
| 3,269,829 | A | 8/1966 | Belkin |

(Continued)

FOREIGN PATENT DOCUMENTS

| | | | |
|---|---|---|---|
| AU | 707438 | B2 | 7/1999 |
| CN | 1051081 | A | 5/1991 |

(Continued)

OTHER PUBLICATIONS

Extended European Search Report for corresponding EP Application No. 12804154.8, dated Feb. 10, 2015, 7 pgs.

(Continued)

*Primary Examiner* — Scott Kastler
(74) *Attorney, Agent, or Firm* — Chernoff, Vilhauer, McClung & Stenzel, LLP

(57) ABSTRACT

A lance for conducting a pyrometallurgical operation by top submerged lancing (TSL) injection, has inner and outer substantially concentric pipes. The lower end of the inner or at least a next innermost pipe is set at a level relative to the lower end of the outer pipe required for the pyrometallurgical operation. The relative positions of the inner and outer pipes are longitudinally adjustable to enable the length of the mixing chamber to be maintained at a desired setting during a period of use to compensate for the lower end of the outer pipe wearing and burning back.

12 Claims, 3 Drawing Sheets

(52) U.S. Cl.
CPC ..... *C21C 5/4673* (2013.01); *C21C 5/34* (2013.01); *F27D 2003/168* (2013.01)

(58) Field of Classification Search
USPC ..... 266/225, 268
See application file for complete search history.

(56) References Cited

U.S. PATENT DOCUMENTS

| | | | | |
|---|---|---|---|---|
| 3,321,139 | A | 5/1967 | De Saint Martin | |
| 3,338,570 | A | 8/1967 | Zimmer | |
| 3,411,716 | A | 11/1968 | Stephan et al. | |
| 3,488,044 | A | 1/1970 | Shepherd | |
| 3,521,872 | A | 7/1970 | Themelis | |
| 3,730,505 | A | 5/1973 | Ramacciotti et al. | |
| 3,802,681 | A | 4/1974 | Pfeifer | |
| 3,828,850 | A | 8/1974 | McMinn et al. | |
| 3,876,190 | A | 4/1975 | Johnstone et al. | |
| 3,889,933 | A | 6/1975 | Jaquay | |
| 4,023,676 | A | 5/1977 | Bennett et al. | |
| 4,097,030 | A | 6/1978 | Desaar | |
| 4,251,271 | A | 2/1981 | Floyd | |
| 4,303,230 | A * | 12/1981 | Bleloch | C21C 5/4606 266/270 |
| 4,326,701 | A | 4/1982 | Hayden, Jr. et al. | |
| 4,396,182 | A | 8/1983 | Schaffar et al. | |
| 4,479,442 | A | 10/1984 | Itse et al. | |
| 4,541,617 | A | 9/1985 | Okane et al. | |
| 5,251,879 | A * | 10/1993 | Floyd | C21C 5/4613 266/225 |
| 5,308,043 | A | 5/1994 | Floyd et al. | |
| 5,498,277 | A | 3/1996 | Floyd | |
| 5,615,626 | A | 4/1997 | Floyd et al. | |
| 5,680,766 | A | 10/1997 | Joshi et al. | |
| 6,368,550 | B1 * | 4/2002 | Wagener | C21C 7/10 266/225 |
| 6,565,800 | B2 | 5/2003 | Dunne | |
| 2014/0151942 | A1 * | 6/2014 | Matusewicz | C21C 5/4613 266/99 |
| 2014/0284852 | A1 * | 9/2014 | Matusewicz | C22B 9/05 266/99 |

FOREIGN PATENT DOCUMENTS

| | | | |
|---|---|---|---|
| CN | 1101078 | A | 4/1995 |
| EP | 0535846 | A2 | 4/1993 |
| EP | 0 597 270 | A2 | 5/1994 |
| EP | 0644269 | A1 | 9/1994 |
| EP | 0535846 | B1 | 11/1996 |
| EP | 0 493 476 | B1 | 12/1998 |
| FR | 2 432 552 | A1 | 2/1980 |
| GB | 876687 | A | 9/1961 |
| GB | 914086 | A | 12/1962 |
| JP | 53-114709 | | 10/1978 |
| JP | 62-29496 | | 6/1987 |
| JP | 5-500555 | | 2/1993 |
| JP | 6-213577 | | 8/1994 |
| JP | 9-143532 | | 6/1997 |
| JP | H10170166 | A | 6/1998 |
| JP | 2001-141376 | | 5/2001 |
| JP | 2009139081 | A | 6/2009 |
| WO | 9802588 | A1 | 1/1998 |
| WO | 0181637 | A1 | 11/2001 |
| WO | 03091460 | A1 | 11/2003 |
| WO | 2006042363 | A1 | 4/2006 |

OTHER PUBLICATIONS

International Search Report for PCT/AU2012/001001 completed Sep. 14, 2012, mailed Sep. 17, 2012, 4 pages.
International Search Report for PCT/IB2012/056714 completed Mar. 11, 2013, mailed Mar. 18, 2013, 5 pages.
Office action from related Japanese patent application No. 2014-517328, mailed Feb. 20, 2015, 7 pgs. with English translation.
Chinese office action from corresponding Chinese patent application No. 201280031778.8, mailed Jun. 23, 2015, 8 pgs.
Chinese office action issued in corresponding Chinese patent application No. 201280031778.8, mailed Nov. 25, 2014, with English translation, 15 pgs.
International Search Report for PCT/AU2012/000751, completed Jul. 24, 2012, mailed Jul. 27, 2012, 4 pages.

* cited by examiner

TOP SUBMERGED INJECTING LANCES

CROSS-REFERENCE TO RELATED APPLICATION

This is a national stage application filed under 35 USC 371 based on International Application No. PCT/AU2012/000751 filed Jun. 27, 2012, and claims priority under 35 USC 119 of Australia Patent Application No. 2011902598 filed Jun. 30, 2011.

FIELD OF THE INVENTION

This invention relates to top submerged injecting lances for use in molten bath pyrometallurgical operations.

BACKGROUND TO THE INVENTION

Molten bath smelting or other pyrometallurgical operations which require interaction between the bath and a source of oxygen-containing gas utilize several different arrangements for the supply of the gas. In general, these operations involve direct injection into molten matte/metal. This may be by bottom blowing tuyeres as in a Bessemer type of furnace or side blowing tuyeres as in a Peirce-Smith type of converter. Alternatively, the injection of gas may be by means of a lance to provide either top blowing or submerged injection. Examples of top blowing lance injection are the KALDO and BOP steel marking plants in which pure oxygen is blown from above the bath to produce steel from molten iron. Another example of top blowing lance injection is provided by the smelting and matte converting stages of the Mitsubishi copper process, in which injection lances cause jets of oxygen-containing gas such as air or oxygen-enriched air to impinge on and penetrate the top surface of the bath, respectively to produce and convert copper matte. In the case of submerged lance injection, the lower end of the lance is submerged so that injection occurs within rather than from above a slag layer of the bath, to provide top submerged lancing (TSL) injection.

With both forms of injection from above, that is, top blowing and TSL injection, the lance is subjected to intense prevailing bath temperatures. The top blowing in the Mitsubishi copper process uses a number of relatively small steel lances which have an inner pipe of about 50 mm diameter and an outer pipe of about 100 mm diameter. The inner pipe terminates at about the level of the furnace roof, well above the reaction zone. The outer pipe, which is rotatable to prevent it sticking to a water-cooled collar at the furnace roof, extends down into the gas space of the furnace to position its lower end about 500-800 mm above the upper surface of the molten bath. Particulate feed entrained in air is blown through the inner pipe, while oxygen enriched air is blown through the annulus between the pipes. Despite the spacing of the lower end of the outer pipe above the bath surface, and any cooling of the lance by the gases passing through it, the outer pipe burns back by about 400 mm per day. The outer pipe therefore is slowly lowered and, when required, new sections are attached to the top of the outer, consumable pipe.

The lances for TSL injection are much larger than those for top blowing, such as in the Mitsubishi process described above. A TSL lance usually has at least an inner and an outer pipe, as assumed in the following, but may have at least one other pipe concentric with the inner and outer pipes. In the TSL lance the outer pipe has a diameter of 200 to 500 mm, or larger. Also, the lance is much longer and extends down through the roof of a TSL reactor, which may be about 10 to 15 m tall, so that the lower end of the outer pipe is immersed to a depth of about 300 mm or more in a molten slag phase of the bath. but is protected by a coating of solidified slag formed and maintained on the outer surface of the outer pipe The inner pipe, of about 100-180 mm diameter, may terminate at about the same level as the outer pipe, or at a higher level of up to about 1000 mm above the lower end of the outer pipe. A helical vane or other flow shaping device may be mounted on the outer surface of the inner pipe to span the annular space between the inner and outer pipes. The vanes impart a strong swirling action to an air or oxygen-enriched blast along that annulus and serve to enhance the cooling effect as well as ensure that gas is mixed well with fuel and feed material supplied through the inner pipe with the mixing occurring substantially in a mixing chamber defined by the outer pipe, below the lower end of the inner pipe where the inner pipe terminates a sufficient distance above the lower end of the outer pipe.

The outer pipe of the TSL lance wears and burns back at its lower end, but at a rate that is considerably reduced by the protective slag coating than would be the case without the coating. However, this is controlled to a substantial degree by the mode of operation with TSL technology. The mode of operation makes the technology viable despite the lower end of the lance being submerged in the highly reactive and corrosive environment of the molten slag bath. The inner pipe of a TSL lance supplies feed materials, such as concentrate, fluxes and reductant to be injected into a slag layer of the bath, as well as fuel. An oxygen containing gas, such as air or oxygen enriched air, is supplied through the annulus between the pipes. Prior to submerged injection within the slag layer of the bath being commenced, the lance is positioned with its lower end, that is, the lower end of the outer pipe, spaced a suitable distance above the slag surface. Oxygen-containing gas and fuel, such as fuel oil, fine coal or hydrocarbon gas, are supplied to the lance and a resultant oxygen/fuel mixture is fired to generate a flame jet which issues beyond the submerged end of the outer pipe and impinges onto the slag. This causes the slag to splash to form, on the outer lance pipe, the slag layer which is solidified by the gas stream passing through the lance to provide the solid slag coating mentioned above. The lance then is able to be lowered to achieve injection within the slag, with the ongoing passage of oxygen-containing gas through the lance maintaining the lower extent of the lance at a temperature at which the solidified slag coating is maintained for protecting the outer pipe.

With a new TSL lance, the relative positions of the lower ends of the outer and inner pipes, that is, the distance the lower end of the inner pipe is set back, if at all, from the lower end of the outer pipe, is an optimum length for a particular pyrometallurgical operating window, determined during the design. The optimum length can be different for different uses of TSL technology. Thus, each of a two stage batch operation for converting copper matte to blister copper with oxygen transfer through slag to matte, a continuous single stage operation for converting copper matte to blister copper, a process for reduction of a lead containing slag, and a process for the smelting an iron oxide feed material for the production of pig iron, all require use a different respective optimum mixing chamber length. However, in each case, the length of the mixing chamber progressively falls below the optimum for the pyrometallurgical operation as the lower end of the outer pipe slowly wears and burns back. Similarly, if there is zero offset between the ends of the outer and inner pipes, the lower end of the inner pipe can become exposed to the slag, with it also being worn and subjected to burn back. Thus, at intervals, the lower end of at least the outer pipe needs to be cut to provide a clean edge to which is welded a length of pipe of the appropriate diameter, to re-establish the optimum relative positions of the pipe lower ends to optimize smelting conditions.

The rate at which the lower end of the outer pipe wears and burns back varies with the molten bath pyrometallurgical operation being conducted. Factors which determine that rate include feed processing rate, operating temperature, bath fluidity, lance flows rates, etc. In some cases the rate of corrosion wear and burn back is relatively high and can be such that in the worst instance several hours operating time can be lost in a day due to the need to interrupt processing to remove a worn lance from operation and replace it with another, whilst the worn lance taken from service is repaired. Such stoppages may occur several times in a day with each stoppage adding to non-processing time. While TSL technology offers significant benefits, including cost savings, over other technologies, the lost operating time for the replacement of lances carries a significant cost penalty.

The present invention is directed to providing an alternative top submerged lance which enables a reduction in time lost through the need for lance replacements.

SUMMARY OF THE INVENTION

According to the present invention, there is provided a lance, for conducting a pyrometallurgical operation by top submerged lancing (TSL) injection, wherein the lance, for conducting a pyrometallurgical operation by top submerged lancing (TSL) injection, wherein the lance has a plurality of substantially concentric pipes including inner and outer pipes and, optionally, at least one pipe between the inner and outer pipes; the lower end of the inner or the inner pipe and at least a next outermost pipe is set substantially at a required level relative to the lower end of the outer pipe required for the pyrometallurgical operation; wherein the relative positions of the inner and outer pipes are longitudinally adjustable to enable the required set level or the length of a mixing chamber between the lower ends of the inner and outer pipes to be maintained during a period of use to compensate for the lower end of the outer pipe wearing and burning back; and wherein the lance defines at least two passages, including an annular passage defined between two of the pipes and a passage defined by the inner pipe, whereby the lance enables fuel/reductant and oxygen-containing gas to be injected separately through the lance so as to mix at the outlet ends of the inner and outer pipes and generate a combustion zone within a slag phase during top submerged injection during the pyrometallurgical operation, while maintaining a protective coating of solidified slag over the outer surface of the outer pipe over at least a lower part of the length of the lance submerged in molten slag during the operation.

In one arrangement, the lower end of the inner pipe has substantially zero offset from the lower end of the outer pipe. In an alternative arrangement, the lower end of the inner pipe is set back from the lower end of the outer pipe so that a mixing chamber is defined between those ends.

The lance may have two pipes, with the helical vane if provided connected at one longitudinal edge to the outer surface of the inner pipe and having its other longitudinal edged adjacent to the inner surface of the outer pipe. However, the pipe may have at least three pipes, with vane connected at the one edge to the outer surface of the pipe next innermost of the outer pipe, with its other edge adjacent to the inner surface of the outer pipe. In the latter case, the pipes other than the outer pipe may be either fixed or longitudinally movable relative to each other.

For use in a TSL pyrometallurgical operation, the lance is able to be suspended from an installation which is operable to raise and lower the lance as a whole relative to the TSL reactor. The installation is able to lower the lance into the TSL reactor to position the lower end of the lance above the surface of a slag phase, at the top of a molten bath in the reactor, to enable formation a slag coating on the lance as detailed above. The installation then is able to lower the lance to position the lower end of the lance in the slag phase and enable submerged injection within the slag. The installation also is able to raise the lance from the reactor. In these movements, the lance is moved bodily. However, the installation also is operable to provide relative longitudinal movement between the inner and outer pipes of the lance. The relative longitudinal movement may be:

(a) lowering of mountings by which the lance as a whole is supported, as the inner pipe is raised relative to the mountings to maintain the lower end of the inner pipe at a substantially constant level, or (b) lowering of the outer pipe relative to the inner pipe, with the inner pipe held stationary.

In each case, the relative longitudinal movement most preferably is such as to maintain a substantially fixed relative positioning between the lower ends of the outer and inner pipes. Thus, where the relative positioning is such as to provide a mixing chamber, the relative longitudinal movement most preferably is such as to maintain the mixing chamber at a substantially fixed, predetermined or selected length. The accuracy with which the predetermined or selected length of the mixing chamber is maintained need only be substantially constant. Thus, the level of the outlet end of the inner pipe relative to the lower end of the outer pipe preferably is able to be maintained by relative movement between the inner and outer pipes to be within ±25 mm of a required level for the inner pipe.

The lance, or an installation including the lance, may have a drive system by which the relative longitudinal movement between the inner and outer pipes is generated. The drive system may be operable to generate the movement at a predetermined rate, based on an assessment of an average rate at which the lower end of the outer pipe wears and burns back. Thus; if it is known for a given pyrometallurgical operation that the wear and burn back is about 100 mm in a four hour shift cycle, then the drive system may generate relative movement between the inner and outer pipes of 25 mm per hour to maintain a substantially constant relative positions for the lower ends of the pipes, such as a substantially constant mixing chamber length.

Use of a drive system providing such constant rate of relative movement between the inner and outer pipes may be based on an assumption as to there being stable operating conditions resulting in a substantially constant rate at which the lower end of the outer pipe wears and burns back. However, the drive may be variable to accommodate a variation in operating conditions. The operating conditions may vary between successive operating cycles, or even within a given cycle, such as due to a change in the grade of a feed material or of a fuel and/or reductant, or due to an increase in the volume of the bath, such as due to an increase in the volume of slag and/or of a recovered metal or matte phase. Also, variation can occur between the stages of a given overall operation, such as between a white metal blow stage and a blister copper blow stage in a two stage copper matte converting process conducted in a single reactor or between successive stages of a three stage lead recovery process. Additionally, variation can result due to a need to operate at an increased temperature to offset an increase in slag viscosity over the course of a smelting operation.

The drive system may be adjustable either manually or by means of a remote control. Alternatively, the drive system may be adjustable in response to an output from at least one sensor able to monitor at least one parameter of the process. For example, the sensor may be one adapted to monitor the composition of reactor off-gases, the reactor temperature at a suitable location, gas pressure above the bath or in a gas off-take duct, the electrical conductivity of a component of the bath, such as the slag phase, the electrical conductivity of the outer pipe of the lance, or it may be an optical sensor for making an optical measure of the actual length of the outer pipe along the length of the lance between the inner and outer pipes, or combination of sensors for monitoring two or more of such parameters.

In order that the invention may more readily be understood, description now is directed to the accompanying drawings, in which.

Figure 1:
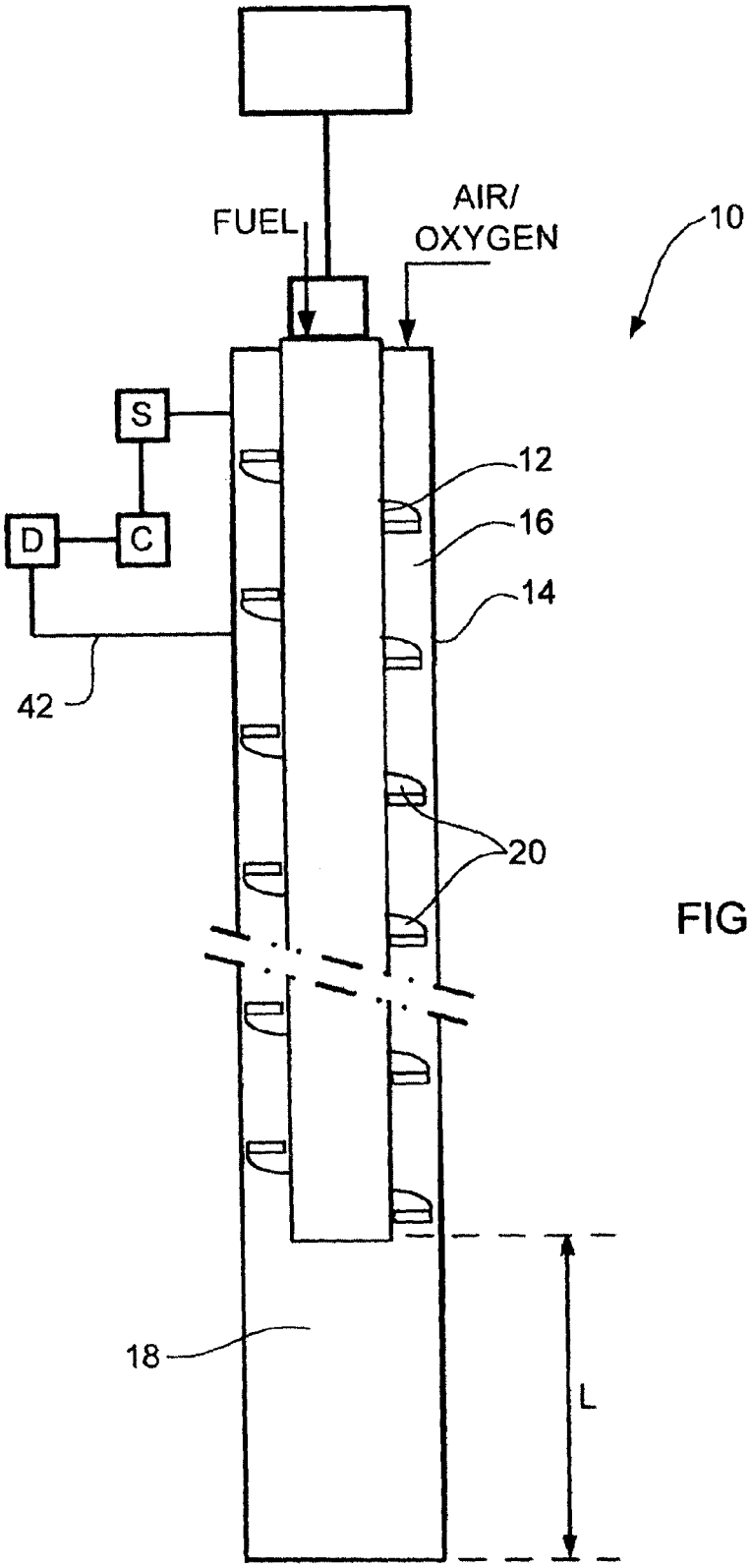
FIG. 1 is a schematic representation of a first form of lance for TSL pyrometallurgical operations.

The lance 10 of FIG. 1 has two concentric steel pipes of circular cross-section. These include an inner pipe 12 and an outer pipe 14. An annular passage 16 is defined between the pipes 12 and 14. Along the passage 16 helical vanes or baffles 20 may be used to enhance cooling. The or each section of the baffles 20 is provided by a strip or ribbon which extends helically around pipe 12, and has one edge welded to the outer surface of pipe 12, while its other edge is closely adjacent to the inner surface of outer pipe 14. The form of the baffle may be similar to that of the swirler strips 14 shown in FIG. 2 of U.S. Pat. No. 4,251,271 to Floyd.

As will be appreciated, the outer pipe 14 and the baffles 20 are shown in longitudinal section to enable viewing of inner pipe 12 and the baffles 20.

The lower end of inner pipe 12 is spaced above the lower end of outer pipe 14 by the distance L. This results in a chamber 18 in the extent of pipe 14 below pipe 12, which functions as a mixing chamber.

In the simple arrangement illustrated, air, oxygen or oxygen-enriched air is supplied to the passage 16, at the upper end of lance 10. A suitable fuel with any required conveying medium is supplied into the upper end of pipe 12. The helical baffle in passage 16 imparts strong swirling action to the gas supplied to passage 16. Thus, the cooling effect of the gas is enhanced and the gas and fuel are intimately mixed together in chamber 18 with the mixture able to be fired to produce efficient combustion of the fuel and generation of a strong combustion flame issuing from the lower end of lance 10. The ratio of oxygen to fuel can be varied, depending on the strength of reducing or oxidising conditions to be generated at or below the lower end of the lance. Oxygen or fuel not consumed in the combustion flame is injected within the slag of the bath, with any component of the fuel which is not combusted being available within the slag as reductant. For this reason it often is indicated in TSL injection that fuel/reductant is injected by the lance. The ratio of fuel to reductant in the "fuel/reductant" varies with the ratio of oxygen to fuel/reductant at given feed rates for both oxygen and fuel/reductant.

The lance 10 is secured at its upper end to an overhead installation by which the lance is able to be raised or lowered, as a whole, as required. The installation is depicted by the mounting device 22, a line 24 and an actuator 26. The installation may comprise a rail mounted overhead crane or winch 26 and a cable 24, with the lance 10 secured to the lower end of cable 24, by a yoke 22 or other suitable securement device.

Figure 2:
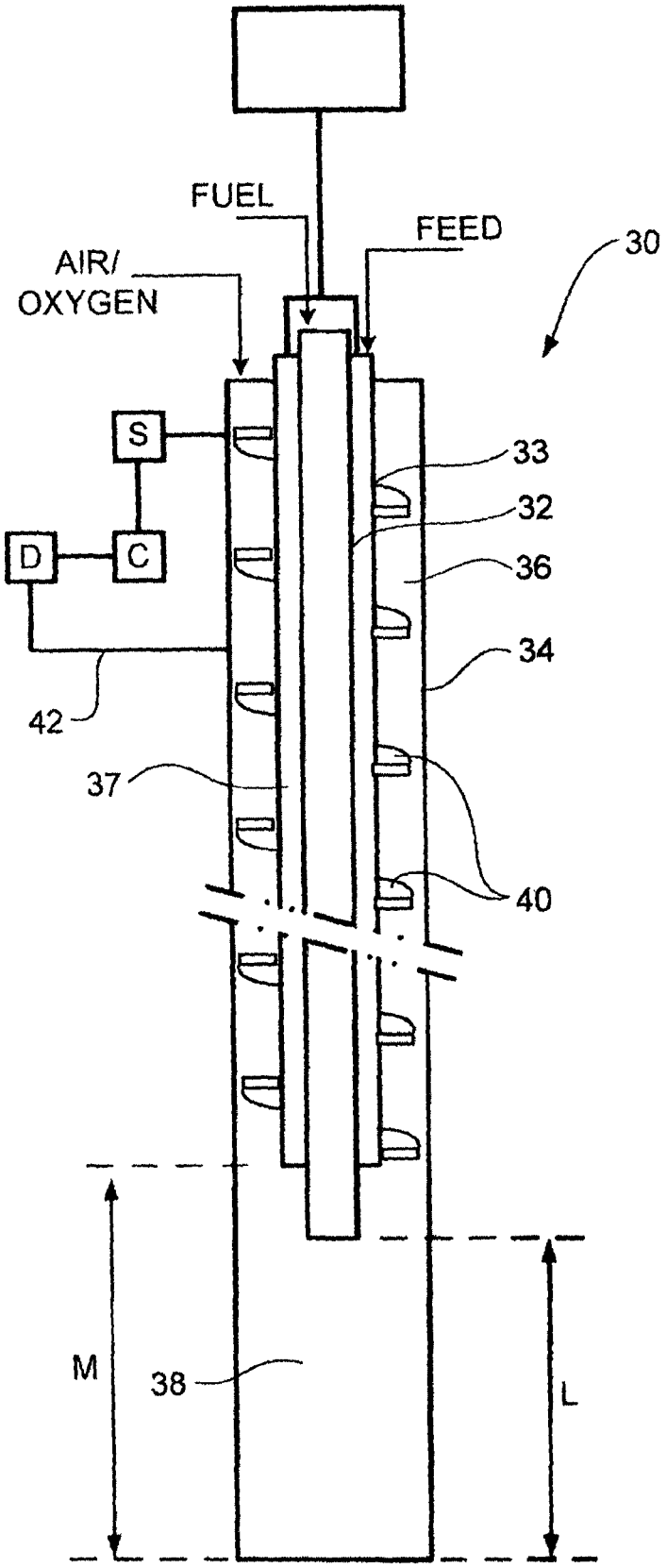
FIG. 2 is a schematic representation of a second form of lance for such operations.

The arrangement for lance 30 shown in FIG. 2 will be understood from the description of FIG. 1. Corresponding parts have the reference as FIG. 1, plus 20. The difference in this instance is that the lance 30 has three concentric pipes, due to a third pipe 33 being positioned between inner and outer pipes 32 and 34. Thus, passage 36 and swirler 40 are between pipes 33 and 34. Then lower end of pipe 33 is set back from the lower end of pipe 34 by a distance (M-L), where M is the distance between the lower ends of pipes 33 and 34 and L is the distance between the lower ends of pipes 32 and 33. Thus, the mixing chamber 38 has an annular extension around the length of pipe 32 which is below the end of pipe 33. Also, pipes 33 and 34, and baffles 40 are shown in longitudinal section to enable components within pipe 34 to be seen.

Again, a helical baffle (not shown) is provided. However, in this instance, the baffle is mounted on the outer surface of pipe 33 and extends across passage 36 so that its outer edge is close to the inner surface of pipe 34.

In this embodiment of a lance 30, fuel is supplied at the upper end of pipe 32, while free-oxygen containing gas is supplied through pipe 34, along passage 36 between pipes 33 and 34. Also, feed material, such as concentrate, granular slag or granular matte, plus flux, may be supplied through pipe 33, along the annular passage 37 between pipe 32 and pipe 33. The mixing of oxygen containing gas and feed commences before the end of pipe 32 and the gas/feed mixture then is mixed with fuel below the end of pipe 32. Again, the fuel is combusted in mixing chamber 36, while the feed can at least be pre-heated, possibly partly melted or reacted, before being injected within the slag layer of a reactor into which lance 30 extends.

As with lance 10, lance 30 is able to be raised or lowered as a whole by a mounting device 42, line 44 and actuator 46. These may be as described for lance 10, or of an alternative form.

As one skilled in the art would appreciate the indicated feed arrangements are examples only of variations to the central concept. The injection annulus or passage chosen for the various gases and solids may be varied without affecting the nature of the invention.

Each of lances 10 and 30 are able to be used in a variety of pyrometallurgical operations, for the production of various metals from a range of primary and secondary feeds, and in the recovery of metals from a range of residues and wastes. The lances 10 and 30 consist of concentric pipes and while two or three pipes are usual, there can be at least one further pipe in lances for some special applications. The lances can be used to inject feeds, fuel and process gases into a molten bath.

In all cases, the pipes of the lance are of a fixed operating length below the roof of a TSL reactor in which the lance is to be used. More specifically, the lance position is relative to the bath, and the overall lance length is typically long enough to reach a fixed distance from the furnace hearth. However, each of lances 10 and 30 is adjustable for the purpose of maintaining a substantially constant length for the respective mixing chamber 16 and 36. In the case of lance 10, the arrangement enables the length L to be kept substantially constant, despite wear and burn back of the lower end of pipe 14 which otherwise would reduce the length L. Similarly, in lance 30, the arrangement enables each of the lengths L and M to be kept substantially constant, despite wear and burn back of the lower end of pipe 34 which otherwise would reduce the lengths L and M. Thus, the length L in lance 10, and the lengths L and M in the case of lance 30 can be maintained at settings providing optimum conditions for top submerged lancing injection of a required pyrometallurgical operation and for required operating conditions.

In the case of lance 30, the passages 36 and 37 enable different materials to be isolated from each other until the materials discharge into chamber 38 and mix. The lance may have at least one further pipe, resulting in a further passage through which a still further material can pass. The at least one further pipe may have a set back distance corresponding to L or M or a distance other than L and M. Also, in lance 30, each of L and M, and the set back distance of any further pipe, may be adjustable to compensate for a required change in operating conditions.

The lances 10 and 30 are shown as having a drive system D of any of a variety of different forms. While each system D is shown as spaced from the respective lance 10, 30 and operatively connected by a line or drive link 42, drive system D may be mounted on lance 10, 30, on an installation from which the lance is suspended and able to be bodily raised or lowered, or on some adjacent structure, depending on the nature of system D. Thus, line or link 42 may be a direct mechanical drive by which one pipe is able to be moved longitudinally relative to another in order to compensate for wear or burn back of the lower end of the outer pipe. Alternatively, the line or link 42 may denote action of system D through a coupling to an installation by which the lance 10, 30 is suspended. In each case, the system D may be operable on a set time-controlled basis, to impart a fixed rate of relative movement between pipes of lance 10, 30. Alternatively, the drive may be operable in response to a signal generated by a control unit C. The arrangement may be such that the signal is adjustable in response to an output from a sensor S which is monitored by control unit C. The sensor may be positioned and operable to provide an output indicative of variation in the length L and M caused by wear and burn back of the lower end of the outer sleeve of lance 10 and 30.

The drive system D and the sensor S may be operable or of a nature detailed earlier herein.

Figure 3:
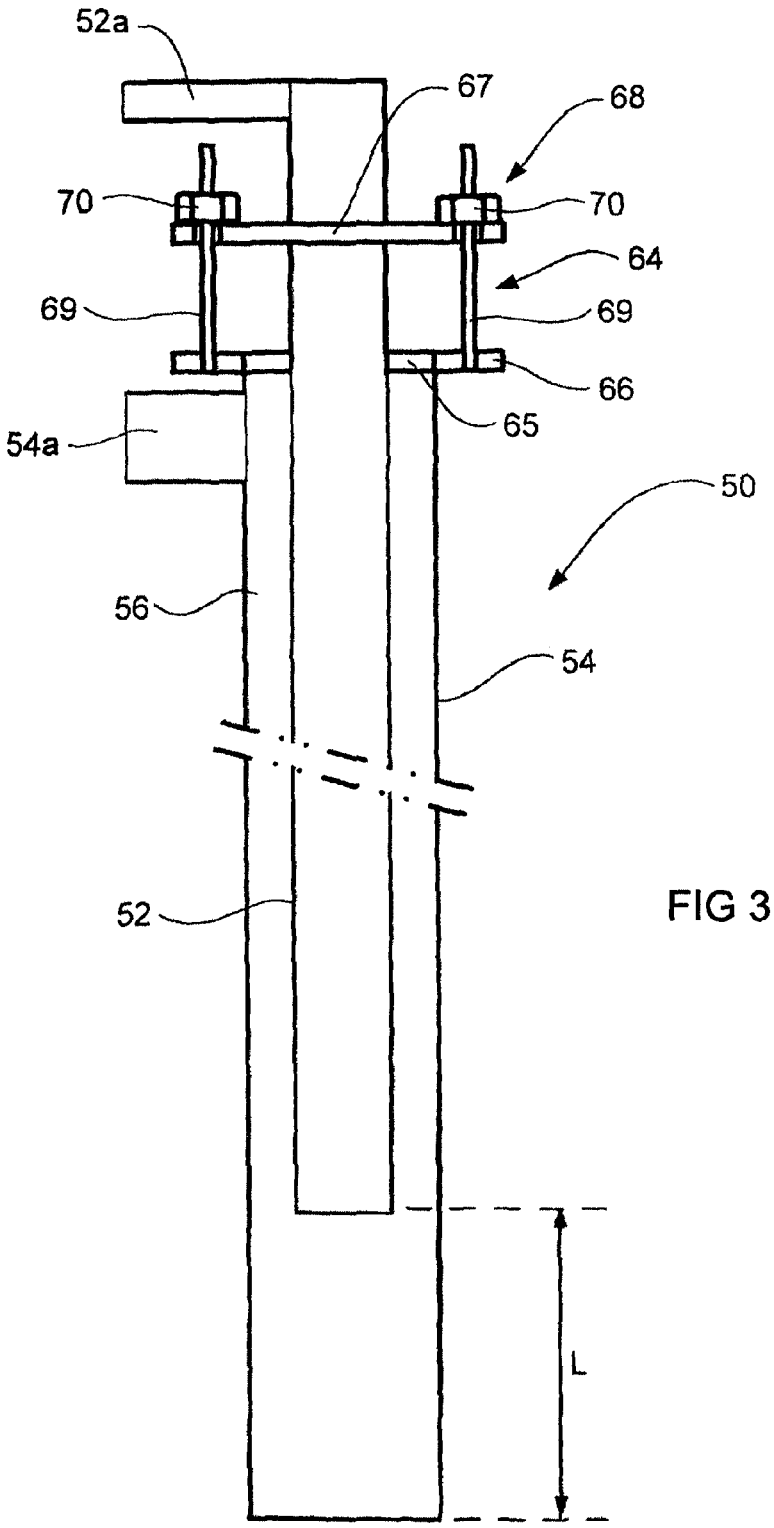
FIG. 3 is a view similar to FIG. 1, but showing one mechanism for achieving relative movement between pipes of a lance.

FIG. 3 shows a lance 50 similar to that of FIG. 1, and corresponding parts have the same reference numbers, plus 40. An installation by which lance 50 is able to be raised or lowered relative to a molten slag both is not shown. However, a mechanical arrangement 64 for providing relative longitudinal movement between inner pipe 52 and outer pipe 54 is shown. Also, FIG. 3 shows a seal 65 mounted at the upper end of lance 50. The seal 65 substantially prevents gas from discharging at the upper end of lance 50. The seal 65 substantially prevents gas from discharging at the upper end of lance 50, while enabling relative longitudinal movement between pipes 52 and 54, and in sliding, sealing contact with pipe 54 or pipe 52, respectively. The arrangement is such that the supply of pressurised gas to the inlet connector 54*a* of pipe 54 results in the gas passing down the passage 56 between pipes 52 and 54 for discharge at the lower end of lance 50.

The arrangement 64 for enabling relative longitudinal movement between pipes 52 and 54 includes a flange, or flanges, 66 mounted on the upper end of pipe 54. Also, the upper end of pipe 52 projects above the upper end of pipe 54, and arrangement 64 includes a flange or flanges, 67 on the upper end of pipe 52, below an inlet connector 52*a* for pipe 52 but above flange, or flanges 66 on pipe 54. To provide the longitudinal movement between the pipes 52 and 54, arrangement 64 includes jacking screws 68 acting between the flanges, 66 and 67. Each screw 68 has a threaded shaft 69 secured to flange, or flanges, 66 and passing upwardly through flange, or flanges, 67, and a nut 70 engaged on the upper end of its shaft 69. Thus, rotation of nuts 70 in one direction draws the shafts 69 upwardly and thereby pulls pipe 54 upwardly relative to pipe 52, while rotation of nuts 70 in the opposite direction enables the reverse longitudinal movement of the shafts 69, and of pipe 54 relative to pipe 52. Thus, the length L of the mixing chamber 58 is able to be maintained substantially constant, despite wearing or burning back of the lower, outlet end of the pipe 54. Alternatively, the length L is able to be adjusted from a setting required for one pyrometallurgical operation to a different length required for another pyrometallurgical operation.

While not shown, lance 50 preferably has a drive system which includes and, when required, operates the arrangement 64. Thus, as in each of FIGS. 1 and 2, a sensor 5 may be provided to provide an output signal indicative of the relative longitudinal position of pipes 52 and 54 with an actuator operable to rotate nuts 70, as required, to vary those positions. The output of the sensor S may pass to a control unit C, with the control unit providing an output signal for drive to the actuator.

The lance of the present invention is able to provide numerous benefits over conventional fixed pipe top submerged lances. These benefits include:

(a) In especially difficult processes where lance wear is unavoidable, the desired mixing chamber length can be maintained for a longer period than with a typical fixed lance to control the oxygen partial pressure into a narrow optimal band for the particular application. This minimises the frequency of lance changes and so allows less interruption to processing.

(b) A variable mixing chamber length allows the mixing chamber to be tailored for the specific fuel used at the time and to be adjusted if there is a variation in the fuel source, including secondary sources such as plastics.

(c) A variable mixing chamber length allows for a full control of the mixing of fuel and air/oxygen depending on the desired discharge requirements at the lance outlet end into the molten slag bath.

(d) A variable mixing chamber length also can prove useful for controlling furnace conditions when the lance is positioned above the bath during hold or standby periods.

Finally, it is to be understood that various alterations, modifications and/or additions may be introduced into the constructions and arrangements of parts previously described without departing from the spirit or ambit of the invention.

The invention claimed is:

1. A lance, for conducting a pyrometallurgical operation by top submerged lancing (TSL) injection, wherein the lance has a plurality of substantially concentric pipes including inner and outer pipes and, optionally, at least one pipe between the inner and outer pipes; the lower end of the inner or the inner pipe and at least a next outermost pipe is set substantially at a required level relative to the lower end of the outer pipe required for the pyrometallurgical operation; and wherein the lance defines at least two passages, including an annular passage defined between two of the pipes and a passage defined by the inner pipe, whereby the lance enables fuel/reductant and oxygen-containing gas to be injected separately through the lance so as to mix at the outlet ends of the inner and outer pipes and generate a combustion zone within a slag phase during top submerged injection during the pyrometallurgical operation, while maintaining a protective coating of solidified slag over the outer surface of the outer pipe over at least a lower part of the length of the lance submerged in molten slag during the operation, wherein the lower end of the inner pipe is set back from the lower end of the outer pipe so that a mixing chamber is defined between those ends; and the lance is adapted for suspension from an installation that is operable to raise or lower the lance as a whole relative to a TSL reactor and enables relative longitudinal movement between the inner and outer pipes, the relative positions of the inner and outer pipes being longitudinally adjustable to enable the required set level or the length of the mixing chamber between the lower ends of the inner and outer pipes to be maintained during a period of use to compensate for the lower end of the outer pipe wearing and burning back, further including a drive system by which the relative longitudinal movement between the inner and outer pipes is generated, and wherein a helical vane or flow shaping device is provided between the outer pipe and the inner pipe or, where the lance has at least three substantially concentric pipes, between the outer pipe or a next innermost pipe between the outer pipe and the inner pipe.

2. The lance of claim 1, wherein the lance has two pipes, with a vane connected at one of opposite longitudinal edges to the outer surface of the inner pipe and its other longitudinal edge adjacent to the inner surface of the outer pipe.

3. The lance of claim 1, wherein the lance has at least three pipes, with a vane connected at one of opposite longitudinal edges to the outer surface of a pipe next innermost of the outer pipe, with its other longitudinal edge adjacent to the inner surface of the outer pipe.

4. The lance of claim 3, wherein the pipes other than the outer pipe are longitudinally fixed relative to each other.

5. The lance of claim 3, wherein the pipes other than the outer pipe are longitudinally movable relative to each other.

6. The lance of claim 1, wherein the lance enables relative longitudinal movement between the inner and outer pipes by the installation lowering a mounting by which the lance as a whole is supported as the inner pipe is raised relative to the mountings.

7. The lance of claim 1, wherein the lance enables relative longitudinal movement between the inner and outer pipes by the inner pipe being lowered while the outer pipe is held stationary.

8. The lance of claim 1, wherein the drive system is operable to generate relative movement at a substantially constant predetermined rate.

9. The lance of claim 1, wherein the drive is variable to accommodate a variation in operating conditions in which the lance is used.

10. The lance of claim 1, wherein the drive system is adjustable manually.

11. The lance of claim 1, wherein the drive system is adjustable by remote control.

12. The lance of claim 1, wherein the lance includes or has an associated sensor able to monitor at least one parameter of a pyrometallurgical operation and to provide an output by which the drive system is adjustable.

* * * * *